US005089148A

United States Patent [19]

Van Blarcom et al.

[11] Patent Number: 5,089,148

[45] Date of Patent: Feb. 18, 1992

[54] LIQUID FABRIC CONDITIONER CONTAINING FABRIC SOFTENER AND PEACH COLORANT

[75] Inventors: David Van Blarcom, West Milford; Donna E. Johnson, Hackensack, both of N.J.

[73] Assignee: Lever Brothers Company, Division of Conopco, Inc., New York, N.Y.

[21] Appl. No.: 618,442

[22] Filed: Nov. 27, 1990

[51] Int. Cl.[5] ..... D06M 13/34; D06M 13/40

[52] U.S. Cl. ..... 252/8.6; 252/8.7; 252/8.8; 252/8.9

[58] Field of Search ..... 252/8.6–8.9

[56] References Cited

U.S. PATENT DOCUMENTS

| | | | |
|---|---|---|---|
| 3,892,669 | 7/1975 | Rapisarda et al. . | |
| 4,134,838 | 1/1979 | Hooper et al. . | |
| 4,137,180 | 1/1979 | Naik et al. . | |
| 4,203,851 | 5/1980 | Ramachandran . | |
| 4,255,294 | 3/1981 | Rudy et al. . | |
| 4,272,413 | 6/1981 | Bauman . | |
| 4,283,192 | 8/1981 | Bauman . | |
| 4,348,305 | 9/1982 | Hennemann et al. . | |
| 4,562,097 | 12/1985 | Walter et al. . | |
| 4,654,163 | 3/1987 | Quack et al. | 252/312 |
| 4,822,499 | 4/1989 | Wahl et al. | 252/8.8 |
| 4,844,820 | 7/1989 | Piper et al. | 252/8.8 |
| 4,863,620 | 9/1989 | Coffindaffer | 252/8.8 |
| 4,897,208 | 1/1990 | Wahl et al. | 252/8.8 |
| 4,994,193 | 2/1991 | Wahl . | |

*Primary Examiner*—A. Lionel Clingman
*Assistant Examiner*—William S. Parks
*Attorney, Agent, or Firm*—A. Kate Huffman

[57] ABSTRACT

A liquid fabric conditioning composition comprising about 1% to about 40% by weight of a fabric softening component and a colorant system comprising a yellow colorant selected from the group consisting of C.I. Acid Yellow No. 17, C.I. Solvent Yellow #33 and C.I. Acid Yellow #3 and a red colorant selected from the group consisting of C.I. Reactive Red #56, C.I. Reactive Red #147 and C.I. Acid Red #52.

19 Claims, No Drawings

LIQUID FABRIC CONDITIONER CONTAINING FABRIC SOFTENER AND PEACH COLORANT

FIELD OF THE INVENTION

The present invention relates to liquid fabric conditioning compositions and conditioning of fabrics in an aqueous wash bath.

RELATED ART

Liquid fabric conditioning compositions containing a colorant are known in the art. Specifically, liquid fabric softening compositions containing a light-stable pink color are described in Wahl U.S. Pat. No. 4,822,499. Softening compositions of a light stable pink color are described in Wahl U.S. Pat. No. 4,897,208. Dyes utilized in the '208 patent are oil soluble and difficult to incorporate in fabric softening compositions.

Piper et al., U.S. Pat. No. 4,844,820 discloses liquid softening compositions of a light unstable pink color requiring protective packaging. Coffindafer U.S. Pat. No. 4,863,620 discloses a liquid fabric conditions composition having a pH of less than 6 and containing specific yellow and blue colorants which provide a yellow color in the composition and which upon dilution and increase of pH to about 7.5 turn blue. However, a liquid fabric conditioning composition having a peach hue has not been described in the art.

It is difficult to produce a peach colored liquid conditioning product which is aesthetically pleasing from the available red, orange and yellow dyes. Many red dyes provide shades of peach but are unacceptable to a consumer because of undesirable orange hues. A combination of a red and an orange colorant, (i.e. C.I. Acid Red #18 and C.I. Pigment Orange 17) produces a desirable peach color, however, many red and yellow, or orange, dye combinations tend to have undesirable color shades. The present invention offers substantially non-fading dyes providing practitioners a variety of colorants to produce a desirable peach color for a liquid fabric softener.

SUMMARY OF THE INVENTION

The present invention concerns the use in liquid fabric conditioning products of specific dyes which produce a peach color. It has been discovered that incorporation of a combination of selected red and yellow dyes into liquid fabric conditioning compositions having a pH of less than about 7 results in an aesthetically pleasing product of peach color.

According to the present invention, a substantially non-fading fabric conditioning composition is provided having a pH : of less than about 7 and containing from about 1% to about 40% of a fabric softening component and about 2 ppm to about 1,000 ppm of a colorant system. The colorant system comprises a yellow colorant selected from the group consisting of C.I. Acid Yellow #17, C.I. Solvent Yellow #33 and C.I. Acid Yellow #3 and a red colorant selected from the group consisting of C.I. Reactive Red #56, C.I. Reactive Red #147, and C.I. Acid Red #52. The fabric softening component employed in the present invention includes a cationic fabric softener and preferably includes additional fabric conditioning compounds.

Liquid conditioning compositions of the present invention include a liquid carrier and may be formulated as diluted or concentrated products.

DETAILED DESCRIPTION OF PREFERRED EMBODIMENTS

The colorant system of the present invention includes a combination of red and yellow colorants which are mostly water-soluble or water-dispersible. A solvent-soluble yellow dye (i.e. C.I. Solvent Yellow 33) is also contemplated within the scope of the invention.

The red colorants are selected from a group consisting of C.I. Reactive Red No. 56, C.I. Reactive Red No. I47, C.I. Acid Red No. 52 and mixtures thereof. The yellow colorants are selected from a group consisting of C.I. Acid Yellow No. 17; C.I. Acid Yellow 3, C.I. Food Yellow 4, C.I. Acid Yellow 73, C.I Solvent Yellow 33 and mixtures thereof. The preferred colorant system comprises combinations of either C.I. Acid Yellow No. 17, C.I. Acid Yellow No. 3 or C.I. Solvent Yellow #33 with each of the red colorants Reactive Red No. 56, C.I Reactive Red No. 147 and C.I. Acid Red No. 52. Most preferred is C.I. Reactive Red No. 56 combined with C.I. Acid Yellow No. #17.

In a preferred embodiment, the red colorant C.I. Reactive Red No. 56 is combined with either C.I. Acid Yellow No. 17 or C.I. Acid Yellow No. 3 in a ratio of about 4:1 to about 1:3 red to yellow dyes. In an especially preferred embodiment the red to yellow dye ratio is about 3:1 to about 1:2 and most preferred is about 3:1 to about 2:1.

When the red colorant C.I. Reactive Red No. 147 is mixed with either C.I. Acid Yellow No. 17 or C.I. Acid Yellow No. 3, the ratios are about 1:1 to about 1:5 red to yellow dyes, preferably about 1:1 to about 1:3, and most preferably about 1:1 to about 1:2.

The red colorant C.I. Acid Red No. 52 may be combined with either C.I. Acid Yellow No. 17 or C.I. Acid Yellow No. 3 in a ratio of about 1:5 to about 1:25 red to yellow dye; preferably about 1:5 to about 1:20 and most preferably from about 1:6 to about 1:12.

The red and yellow colorants employed in the present invention can be obtained from the following suppliers:

| Colorant | Trademark | Supplier |
|---|---|---|
| C.I. Reactive Red #56 | Drimarene Brilliant Red X-2B | Sandoz Chemicals |
| C.I. Reactive Red #147 | Drimarene Brilliant Red R/K -4BL | Sandoz Chemicals |
| C.I. Acid Red #52 | Sandolan Rhodamine E-B PDR 400 | Sandoz Chemicals |
| C.I. Acid Yellow #17 | Hidacid Fast Light Yellow #2G | Hilton Davis Div. of Sterling Drug |
| C.I. Acid Yellow #3 | D&C Yellow #10 | Hilton Davis |
| C.I. Acid Yellow #4 | Hidacid Fast Light Yellow GR | Hilton Davis, |
| C.I. Acid Yellow #73 | D&C Yellow #8 | Hilton Davis |
| C.I. Solvent Yellow #33 | D&C Yellow #11 | Tricon Colors |

It should be understood that equivalent dyes that are not certified but that correspond chemically to the above certified dyes, are also included in the present invention.

The amount of each of the yellow and red colorants used in the present invention may be in the range of from about 1 ppm to about 500 ppm, preferably from about 2 ppm to about 200 ppm, most preferably from about 3 ppm to about 35 ppm.

It is noted that the red colorant C.I. Acid Red #52 produces a strong color and it is preferable to use a lesser concentration of the red colorant in combination with the yellow colorant to achieve the desired peach color. In particular, a preferred range of the C.I. Acid #52 in the colorant system is in the range of from about I ppm to about I00 ppm; preferably from about 1 ppm to about 50 ppm and most preferably from about 1 ppm to about 25 ppm.

The fabric softening component employed in the present invention includes a cationic fabric softening compound, preferably a quaternary ammonium compound. The counterion may be a halide, such as fluoride, chloride, bromide, or iodide. Other counterions may be employed such as methylsulfate, ethylsulfate, hydroxide, acetate, formate, sulfate, carbonate and the like. Preferably, the counterion is chloride or methylsulfate, chloride being especially preferred for liquid fabric conditioning compositions of the present invention.

Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium chloride (Adogen 432 ® from Sherex), di(hydrogenated tallow)dimethyl ammonium chloride (Adogen 442 ® from Sherex), distearyldimethyl ammonium chloride (Arosurf TA-100 ® from Sherex), dicocodimethyl ammonium chloride (Variquat K300 ® from Sherex), and the like;

(2) Cyclic quaternary ammonium salts of the imidazolinium type such as di(hydrogenated tallow)-dimethyl imidazolinium chloride, 1-ethylene-bis(2-tallow-1-methyl) imidazolinium chloride (Varisoft 6112 ® from Sherex) and the like;

(3) Diamido quaternary ammonium salts such as: methyl-bis(hydrogenated tallow amidoethyl)-2-hydroxyethyl ammonium methylsulfate (Varisoft 110 ® from Sherex), methyl bis(tallowamidoethyl)-2-hydroxypropyl ammonium methylsulfate (Varisoft 238 ® from Sherex) and the like;

(4) Biodegradable quaternary ammonium salts such as N,N-di(tallowoyl-oxy-ethyl)-N,N,-dimethyl ammonium chloride and N,N-di(tallowoyl-oxy-propyl)-N,N-dimethyl ammonium chloride. When fabric conditioning compositions employ biodegradable quaternary ammonium salts, pH of the composition is preferably adjusted to between about 2 and about 5. Biodegradable quaternary ammonium salts mentioned above are described more fully in U.S. Pat. Nos. 4,767,547 and 4,788,491 incorporated by reference herein.

Preferred biodegradable quaternary ammonium salts Which may be employed in the present invention include the biodegradable cationic diester compounds of the formula:

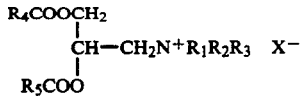

These cationic diesters are described in greater detail in U.S. Pat. No. 4,137,180, herein incorporated by reference.

(5) Mixtures of water-insoluble cationic fabric softener and a polyalkoxylated ammonium salt as described in U.S. Pat. No. 4,422,949 the disclosure of which is incorporated by reference herein. Such mixtures may be particularly suitable for incorporation in a concentrated form of the liquid compositions herein.

Cationic nitrogenous salts having one long chain acyclic aliphatic $C_{8-30}$ aliphatic group, preferably $C_{12-22}$, may also be employed as the cationic fabric softening compound herein. Examples include but are not limited to:

1) Acyclic quaternary ammonium salts. These include for instance monoalkyltrimethylammonium salts such as monotallowtrimethylammonium chloride, mono(hydrogenated tallow)trimethylammonium chloride, palmityltrimethylammonium chloride and soyatrimethylammonium chloride, sold by Sherex Chemical Company under trademarks Adogen ® 471, Adogen ® 441, Adogen ® 444 and Adogen ® 415. Also included are behenyltrimethyl ammonium chloride, soyadimethylethylammonium ethylsulfate and methyl-bis(2-hydroxywthyl)octadecylammonium chloride.

2) Substituted imidazolinium salts, such as 1-ethyl-1-(2-hydroxyethyl)-2-isoheptadecylimidazolinium ethylsulfate.

3) Alkylpyridinium salts.

4) Akanamide alkylene pyridinium salts.

The fabric softening component may include other fabric conditioning compounds in addition to the cationic fabric softening compounds described above. Particularly suitable additional fabric softeners employed herein can be selected from the following classes of compounds:

(i) Tertiary fatty amines having at least one and preferably two $C_8$ to $C_{30}$, preferably $C_{12}$ to $C_{22}$ alkyl chains. Examples include trihydrogenated tallow amine (Adogen 340 ® from Sherex) and cyclic amines such as 1-(hydrogenated tallow) amidoethyl-2-(hydrogenated tallow) imidazoline. Cyclic amines which may be employed for the compositions herein are described in U.S. Pat. No. 4,806,255, incorporated by reference herein.

(ii) Reaction products of stearic acid and aminoethylethanolamine known as stearamidoethyl ethanolamine (Ceranine Chemical Base 39 ® from Sandoz). When fabric conditioning compositions employ such reaction products, pH of the composition is preferably adjusted to between about 2 and about 5.

(iii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN60 (ICI) which is a mixture of sorbitan and isosorbide stearates.

(v) Fatty alcohols, ethoxylated fatty alcohols, alkyl phenols, ethoxylated alkyl phenols, ethoxylated fatty amines, ethoxylated fatty amides (tallow monoethanolamide which is ethoxylated with five moles of EO-Varamide T-55 ® from Sherex), ethoxylated lycerides and ethoxylated diglycerides.

(vi) Mineral oils, and polyols such as polyethylene glycol.

Preferred fabric softeners for use herein are acyclic quaternary ammonium salts, ditallowdimethyl ammonium chloride being most preferred for fabric conditioning compositions of the present invention.

An especially preferred fabric softener component is made up of a combination of an acyclic quaternary ammonium salt and an ethoxylated fatty amide, particularly as described in U.S. Pat. No. 4,497,716, incorporated herein by reference. In particular the ammonium salt, di(hydrogenated tallow) dimethyl ammonium chloride (Adogen 442® from Sherex) may be combined with the ethoxylated fatty amide, tallow monoethanolamide (Varamide T-55® from Sherex) preferably in a ratio of from about 10:1 to about 1:1 and more preferably in a ratio of from about 6:1 to about 1:1 based on 100% activity of the ammonium salt. In a most preferred embodiment the ratio of the ammonium salt to the amide is from about 4:1 to about 5:1.

It may be appreciated that various combinations of fabric conditioning compounds may be used by the skilled artisan to form the fabric softening component within the scope of the invention.

About 1% to about 40% of the fabric softening component is used in the compositions of the invention. There must be included at least a sufficient amount of the cationic fabric softening compound to achieve antistatic effect, for example at least about 1% to about 3% in the dilute product and at least about 2% to about 5% in the concentrated product. On the other hand, the entire fabric softening component may be a cationic fabric softening compound. The diluted version of the product contains about 1% to about 12%, preferably about 3% to about 10% and most preferably about 4% to about 7% of the fabric softening component, based on % active. The concentrated version of the product contains about 13% to about 40%, preferably about 13% to 30% and most preferably about 13% to about 20% of the fabric softening component, based on % active.

The fabric conditioning compositions of the present invention include a liquid carrier, which is water and which may additionally contain organic solvents such as lower alcohols selected from, for example, methyl alcohol, ethyl alcohol and isopropanol. Other liquid carriers include/alkylene glycols such as ethylene glycol, and preferably propylene glycol. Both the diluted and the concentrated versions of the product are preferably dispersions of the active ingredients in the water solvent matrix.

According to the present invention the pH of liquid fabric conditioning compositions is less than about 7, and is preferably in the range of from about 2.5 to about 6.5. Typically, there is no need to adjust pH of the compositions. However, if there is a need to adjust pH of the compositions, any acidic material may be used. Examples of suitable acids include hydrochloric, sulfuric, phosphoric, citric, maleic and acetic acids and the like. The pH is measured by a glass electrode in comparison with a standard calomel reference electrode.

Various additives may be optionally employed in the conditioning compositions of the present invention. These include silicones, such as predominantly linear polydialkylsiloxanes, e.g. polydimethylsiloxanes; soil release polymers such as block copolymers of polyethylene oxide and terephthalate; fatty amines selected from the group consisting of primary fatty amines, secondary fatty amines, tertiary fatty amines and mixtures thereof; amphoteric surfactants; smectite type inorganic clays; anionic soaps; zwitterionic quaternary ammonium compounds and nonionic surfactants.

The fabric conditioning compositions of the present invention also may optionally contain an agent which produces a pearlescent appearance. Preferred pearlizing agents include an organic pearlizing compound such as ethylene glycol distearate, or inorganic pearlizing pigments such as microfine mica. Titanium dioxide ($TiO_2$) coated mica is an especially preferred pearlizing agent. Other pearlizing agents known in the art may be used in the present invention by the skilled artisan, such as for example those described in U.S. Pat. No. 4, 654,163 issued to Quack et al., herein incorporated by reference.

The organic pearlizing agent, ethylene glycol distearate, may be added to the composition in the amount and manner described in pending U.S. application Ser. No. 07/486,038 filed on Feb. 27, 1990, herein incorporated by reference. Specifically, a preferred fabric conditioning composition comprises:

(i) an aqueous base
(ii) a cationic fabric softener material;
(iii) a fatty acid material; and
(iv) ethylene glycol distearate.

Aqueous fabric conditioning compositions generally comprise a dispersed phase of the active materials, such a phase can for instance be prepared by co-melting the active materials followed by mixing the co-melt under stirring into water.

Compositions according to the present invention may contain the ethylene glycol distearate component as part of the cationic dispersed phase. Surprisingly, however, it has been found that the pearlescent appearance is even more pronounced, when the ethylene glycol distearate is present as a separate dispersed phase in the composition.

In the preparation of a fabric softening composition, the formation of a separate dispersed phase for the ethylene glycol distearate may for instance be effected by adding the ethylene glycol distearate in the form of a separate predispersion, after the forming of the first dispersed phase of other active materials.

The ethyleneglycol distearate ingredient of compositions according to the present invention can be added as such; in that case the compositions according to the invention are preferably heated above the melting temperature of the ethyleneglycol distearate to allow the formation of ethyleneglycol distearate crystals upon cooling. These crystals are believed especially to be advantageous as far as the appearance of the product is concerned.

Especially preferred is the addition of the ethyleneglycol distearate component in the form of a predispersion. This generally avoids the need of heating the product above the melting temperature of the ethylene glycol distearate while still providing the appearance advantages.

The predispersion of ethylene glycol distearate is preferably of cationic or nonionic nature. Examples of cationic/nonionic predispersions are for instance disclosed in U.S. Pat. Nos. 4,654,163 and 4,777,038, which are incorporated by reference herein.

The amount of ethylene glycol distearate in compositions according to the present invention is preferably such that the weight ratio of cationic fabric softening material to ethyleneglycol distearate is between about 100:1 and 1:1, more preferably between about 25:1 and 2:1, especially preferred between about 20:1 and 5:1.

The level of ethylene glycol distearate is preferably above 0.1% by weight, more preferred above 0.2% by weight, especially preferred above 0.3% by weight of the composition. For reasons of costs and stability the level of ethylene glycol distearate is preferably not above 10%, more preferred not more than 5%, most preferred not more than 2.5% by weight of the composition.

Typical products according to the present invention may for instance comprise from 0.2 to 2%, more preferred from 0.3 to 1.5% by weight of ethylene glycol distearate.

Compositions according to the present invention preferably also comprise a fatty acid component. Especially suitable combinations of fatty acid and cationic softening materials are disclosed in U.S. Pat. No. 4,308,024, incorporated by reference herein. Typical blends of cationic materials and fatty acids suitable for being used in conjunction with ethylene glycol distearate in compositions according to the present invention include 20–95 mole % of a cationic softening material and 5–80 mole % of a fatty acid material.

Preferably, the pearlizing agent used in the present invention is mica and more preferably mica which has been coated with titanium dioxide ($TiO_2$). The $TiO_2$ coated mica should have a particle size in the range of about 1 to about 15 microns for stability. Such a coated mica product may be obtained from EM Industries, Inc. of Hawthorne, N.Y. under the trademark Afflair ® 110 or Afflair ® 111, preferably Afflair ® 111.

The $TiO_2$ mica is preferably added to the fabric softener composition in a range of about 0.01% to about 1.0% by weight, and preferably in a range of about 0.05% to about 0.4%, and most preferably about 0.10% to about 0.20% by weight.

Other optional ingredients include emulsifiers, electrolytes (for example, sodium chloride or calcium chloride) preferably in the range from 5 to 500 ppm, optical brighteners or fluorescent agents preferably in the range from 0.01 to 5%, buffers, perfumes preferably from 0.1 to 5%, germicides, bactericides, and bacteriostatic agents. Bacteriostatic agents are preferably employed in the range from 1 to 1000 ppm, based on % active of such agent.

It has been found particularly desirable to include in the inventive compositions deodorant perfumes disclosed in U.S. Pat. No. 4,134,838 incorporated by reference herein. According to the present invention, the compositions preferably include from 0.01 to 10%, preferably 0.1% to 1% by weight of a deodorant perfume described in the '838 patent.

The liquid fabric conditioning compositions can be prepared by conventional methods. A convenient and satisfactory method is to prepare the softening active premix at about 50°–80° C., which is then added with stirring to the hot water. Temperature-sensitive components can be added after the fabric softening composition is cooled to a lower temperature. The colorant combination may be prepared and added to the composition at any point to produce the colorant system. Preferably, the colorant system is added to the hot water prior to the mixing with the active premix.

The fabric conditioning compositions of the invention can be used in the rinse cycle of a conventional home laundry operation. Generally, rinse water has a temperature of from about 5° C. to about 60° C. The concentration of the total active ingredients is generally from about 2 ppm to about 1000 ppm, preferably from about 10 ppm to about 500 ppm, by weight of the aqueous rinsing bath. When multiple rinses are used, the fabric conditioning compositions are preferably added to the final rinse.

Typically, the amount of staining possibly imparted to the fabric by any fabric softener depends on the type of fabric, the concentration of the dye in the composition, and whether there is a direct contact of the fabric conditioner with the fabric. Preferably, to minimize the possibility of staining, the fabric softener of the present invention is added after a laundry machine is filled or at least partially filled with water, in order to avoid direct contact of the fabric softener with fabrics in the wash. Alternatively, the fabric softener composition may be diluted with at least about an equal amount of water, and the resulting mixture may be introduced in a washing machine before or during the rinse cycle.

The following Examples will more fully illustrate the embodiments of this invention. All parts, percentages and proportions referred to herein and in the appended claims are by weight of the composition unless otherwise indicated.

| | % by Weight | | | | | | |
|---|---|---|---|---|---|---|---|
| Ingredient | A | B | C | D | E | F | G |
| Adogen ® 442[1] (76.9%) | 8.127 | 8.127 | 8.127 | 8.127 | 8.127 | 9.753 | — |
| Adogen ® 442[1] (74.7%) | — | — | — | — | — | — | 8.366 |
| Ucarcide ® Antimicrobial 250[2] (50%) | 0.14 | 0.14 | 0.14 | 0.14 | 0.14 | 0.14 | 0.14 |
| Afflair ® 111[3] | 0.15 | 0.15 | 0.15 | 0.15 | 0.15 | 0.15 | 0.15 |
| Perfume | 0.35 | 0.35 | 0.35 | 0.35 | 0.35 | — | 0.35 |
| Calcium Chloride (10%) | 0.0665 | 0.0665 | 0.0665 | 0.0665 | 0.0665 | 0.133 | 0.09 |
| C.I. Reactive Red #56[4] | 0.001808 | 0.000904 | 0.000452 | 0.0010 | 0.0008 | 0.001248 | 0.001248 |
| C.I. Acid Yellow #17[5] | 0.000452 | 0.000452 | 0.000452 | 0.0020 | 0.0024 | 0.000452 | 0.000452 |
| Water | to 100% | to 100% | to 100% | to 100% | to 100% | to 100% | to 100% |
| pH | 4.41 | 4.49 | 4.38 | 4.42 | 4.49 | 4.61 | 5.50 |

[1]Obtained from Sherex
[2]Obtained from Union Carbide
[3]Obtained from E M Industries, Inc.
[4]Obtained from Sandoz Chemicals
[5]Obtained from Hilton Davis Compositions A through E were prepared by preheating Adogen 442 ® to 140° F. An aqueous phase was then prepared by mixing and heating to about 135° F. Ucarcide ® antimicrobial and most of the water of the composition. Subsequently, the preheated Adogen was added to the 135° F. aqueous phase with stirring. The Afflair ® 111, perfume, $CaCl_2$, and make up water (up to 95% of the total batch weight) were then added to the aqueous phase between 120° F. and 95° F. to form the batch. The colorants required to produce the desired peach hues were post added to the batch at ambient temperature along with any remaining water.

Compositions F and G were prepared using the same processing procedure as that used for A through E, however the colorants used to produce the desired peach hues were added to the 135° F. aqueous phase (containing Ucarcide ® antimicrobial and water) rather than being post added to the batches.

Compositions A through G were all observed to produce desirable peach colors within the scope of the invention ranging from the red to the yellow end of the spectrum. Compositions F and G are particularly preferred peach colored composition variants.

The presence of the Afflair ® 111 in the composition additionally adds a desirable pearlescent appearance to the compositions and contributes to their color stability when exposed to to sunlight long term. Example 2 illustrates the desirable role that Afflair ® 11 1plays to protect the colorant system when exposed to direct sunlight.

| Ingredient | by Weight G | H | I |
|---|---|---|---|
| Adogen ® 442[1] (74.7%) | 8.366 | 8.366 | 8.366 |
| Ucarcide ® Antimicrobial 250[2] (50%) | 0.14 | 0.14 | 0.14 |
| Afflair ® 111[3] | 0.15 | 0.20 | 0.10 |
| Perfume | 0.35 | 0.35 | 0.35 |
| Calcium Chloride (10%) | 0.09 | 0.097 | 0.117 |
| C.I. Reactive Red #56[4] | 0.001248 | 0.001248 | 0.001248 |
| C.I. Acid Yellow #17[5] | 0.000452 | 0.000452 | 0.000452 |
| Water | to 100% | to 100% | to 100% |
| pH | 5.50 | 5.56 | 5.16 |

[1]Obtained from Sherex
[2]Obtained from Union Carbide
[3]Obtained from E M Industries, Inc.
[4]Obtained from Sandoz
[5]Obtained from Hilton Davis Compositions G, H, and I were prepared as described for Composition G in Example 1, except that the amount of Afflair ® 111 was varied in the three batches. Specifically, compositions G, H, and 1 were formulated with 0.15, 0.20, and 0.10% by weight Afflair ® 111, respectively.

Portions of each composition were then placed into 1) clear glass jars which were left exposed to direct sunlight, and 2) into foil covered glass jars which were kept in the dark. After aging for 2 weeks, 25 days, and 2 months, the jars were inspected for signs of composition color fading.

After two weeks of aging, all three compositions left in the sunlight were observed to be unchanged with respect to their color, and similar in color intensity to the corresponding compositions kept in the dark.

After 25 days of aging in the sunlight, the peach composition (I) containing 0.10% Afflair ® 111 appeared to be slightly faded compared to the colors of compositions G and H (containing 0.15% and 0.20% Afflair ® 111), which appeared unchanged. The same three compositions kept in the dark were unchanged in color.

After 2 months of aging in the sunlight, all three compositions (G, H, I) appeared to be slightly faded, while the same compositions kept in the dark were not.

It is obvious that the higher concentrations of Afflair ® 111 in samples G and H (i.e. 0.15% and 0.20%) protected the colorant system more effectively against fading due to sunlight than the compositions with the lowest concentration of Afflair ® 111 (i.e. 0.10%).

| Ingredient | % by Weight J | K | L |
|---|---|---|---|
| Adogen ® 442[1] (76.9%) | 8.127 | 8.127 | 8.127 |
| Ucarcide ® Antimicrobial 250[2] (50%) | 0.14 | 0.14 | 0.14 |
| Perfume | 0.35 | 0.35 | 0.35 |
| Calcium Chloride (10%) | 0.132 | 0.132 | 0.132 |
| C.I. Reactive Red #56[3] | — | — | 0.0010 |
| C.I. Reactive Red #147[4] | — | 0.001 | — |
| C.I. Acid Red #52[5] | 0.00019 | — | — |
| C.I. Acid Yellow #17[6] | 0.001235 | 0.001 | 0.0020 |
| Water | to 100% | to 100% | to 100% |
| pH | 4.40 | 4.36 | 4.39 |

[1]Obtained from Sherex
[2]Obtained from Union Carbide
[3]Obtained from Sandoz Chemicals
[4]Obtained from Sandoz Chemicals
[5]Obtained from Sandoz Chemicals
[6]Obtained from Hilton Davis Compositions J-L were prepared as described for Compositions A-E in Example 1 except that Afflair ® 111 was not added to the mixtures. All three compositions exhibited desirable peach color within the scope of the present invention.

| Ingredient | % by Weight M | N | O | P | Q |
|---|---|---|---|---|---|
| Adogen ® 442[1] (76.9%) | 8.127 | 8.127 | 8.127 | — | 8.127 |
| 1-trimethyl ammonium 2,3-di(C14–C18 acyloxy) propane chloride (69.0%) | — | — | — | 9.058 | — |
| Ucarcide ® Antimicrobial 250[2] (50%) | 0.14 | 0.14 | 0.14 | 0.14 | 0.14 |
| Afflair ® 111[3] | 0.15 | 0.15 | 0.15 | — | 0.15 |
| Perfume | 0.35 | 0.35 | 0.35 | 0.35 | 0.35 |
| Calcium Chloride (10%) | 0.0665 | 0.0665 | 0.0665 | 0.20 | 0.0665 |
| C.I. Acid Yellow #17[4] | — | 0.003 | 0.000452 | — | 0.00066 |
| C.I. Reactive Red #56[5] | 0.0014 | — | 0.002712 | 0.0014 | — |
| C.I. Reactive Red #147[6] | — | — | — | — | 0.00133 |
| Water | to 100% | to 100% | to 100% | to 100% | to 100% |
| pH | 4.45 | 4.43 | 4.32 | 2.82 | 4.41 |

[1]Obtained from Sherex
[2]Obtained from Union Carbide
[3]Obtained from E M Industries, Inc.
[4]Obtained from Hilton Davis
[5]Obtained from Sandoz Chemicals
[6]Obtained from Sandoz Chemicals Liquid fabric softener compositions M, N, O, and Q were prepared as described for Compositions A—E of Example 1, with the colorants being post added.

Composition P, based on a biodegradable cationic diester, was prepared as follows. The aqueous phase was prepared by mixing and heating to about 160° F., Ucarcide ® antimicrobial, calcium chloride, and the major portion of the compositions water content. The biodegradable cationic diester was preheated to about 150° F., then added to the aqueous phase with constant stirring. At about 135° F., the perfume and additional water (up to 95% of the total batch weight) were then added to the aqueous phase. The specified colorants were post added to the mixture at ambient temperature with the remainder of the composition's water requirement.

Compositions M and P were prepared without the presence of a yellow dye as part of the colorant system. The two compositions were observed to be pink in appearance and, as such, are outside the scope of the present invention.

Composition N was prepared without the presence of a red dye as part of the colorant system. The composition was observed to be yellow in appearance and, as such, is outside the scope of the present invention.

Compositions O and Q were prepared with both a red and yellow colorant, however the ratios of the red to yellow colorants used in those compositions produced a noticeably pink color, instead of the desirable peach hues of the invention and, as such, are outside the scope of the present invention.

| Ingredient | % by Weight | | | | |
|---|---|---|---|---|---|
| | R | S | T | U | V |
| Adogen ® 442[1] (76.9%) | 8.127 | 8.127 | 8.127 | 8.127 | 8.127 |
| Ucarcide ® Antimicrobial 250[2] (50%) | 0.14 | 0.14 | 0.14 | 0.14 | 0.14 |
| Afflair ® 111[3] | 0.15 | 0.15 | 0.15 | 0.15 | 0.15 |
| Perfume | 0.35 | 0.35 | 0.35 | 0.35 | 0.35 |
| Calcium Chloride (10%) | 0.0665 | 0.0665 | 0.0665 | 0.0665 | 0.0665 |
| C.I. Acid Yellow #17[4] | 0.001 | 0.00133 | 0.0015 | 0.0016 | 0.00166 |
| C.I. Reactive Red #147[5] | 0.001 | 0.00066 | 0.0005 | 0.0004 | 0.00033 |
| Water | to 100% | to 100% | to 100% | to 100% | to 100% |
| pH | 4.50 | 4.44 | 4.45 | 4.40 | 4.54 |

[1]Obtained from Sherex
[2]Obtained from Union Carbide
[3]Obtained from E M Industries, Inc.
[4]Obtained from Hilton Davis
[5]Obtained from Sandoz Chemicals Compositions R through V were prepared as described for Compositions A–E in Example 1. The red colorant (Reactive Red #147) in combination with the yellow colorant (Acid Yellow #17) of the claimed colorant system produced desirable shades of peach when used in the various amounts and ratios as described above.

| Ingredient | % by Weight | | | | | |
|---|---|---|---|---|---|---|
| | W | X | Y | Z | AA | BB |
| Adogen ® 442[1] (76.9%) | 8.127 | 8.127 | 8.127 | 8.127 | 8.127 | 8.127 |
| Ucarcide ® Antimicrobial 250[2] (50%) | 0.14 | 0.14 | 0.14 | 0.14 | 0.14 | 0.14 |
| Afflair ® 111[3] | 0.15 | 0.15 | 0.15 | 0.15 | 0.15 | 0.15 |
| Perfume | 0.35 | 0.35 | 0.35 | 0.35 | 0.35 | 0.35 |
| Calcium Chloride (10%) | 0.0665 | 0.0665 | 0.0665 | 0.0665 | 0.0665 | 0.0665 |
| C.I. Acid Red No. 52[4] | 0.00019 | 0.00025 | 0.000115 | 0.00009375 | 0.0000952 | 0.0000769 |
| C.I. Acid Yellow #17[5] | 0.001235 | 0.00125 | 0.00138 | 0.00140 | 0.00190 | 0.00192 |
| Water | to 100% | to 100% | to 100% | to 100% | to 100% | to 100% |
| pH | 4.48 | 4.43 | 4.50 | 4.53 | 4.53 | 4.53 |

[1]Obtained from Sherex
[2]Obtained from Union Carbide
[3]Obtained from E M Industries, Inc.
[4]Obtained from Sandoz Chemicals
[5]Obtained from Hilton Davis Compositions W through Z, AA, and BB were prepared as described for Compositions A–E in Example 1. The red colorant (Acid Red No. 52) in combination with the yellow colorant (Acid Yellow No. 17) of the claimed colorant system produced desirable shades of peach when used in the various amounts and ratios as described above.

| Ingredient | % by Weight | | | | | |
|---|---|---|---|---|---|---|
| | CC | DD | EE | FF | GG | HH |
| Adogen ®[1] 442 (76.9%) | 8.127 | 8.127 | 8.127 | 8.127 | 8.127 | 8.127 |
| Ucarcide ® Antimicrobial 250[2] (50%) | 0.14 | 0.14 | 0.14 | 0.14 | 0.14 | 0.14 |
| Afflair ® 111[3] | 0.15 | 0.15 | 0.15 | 0.15 | 0.15 | — |
| Perfume | 0.35 | 0.35 | 0.35 | 0.35 | 0.35 | 0.35 |
| Calcium Chloride (10%) | 0.0665 | 0.132 | 0.132 | 0.132 | 0.132 | 0.132 |
| Propylene Glycol | — | — | — | 0.499 | 0.616 | 0.226 |
| C.I. Acid Red No. 56[4] | — | — | 0.001356 | — | — | 0.001356 |
| C.I. Reactive Red #147[5] | 0.0010 | — | — | 0.001 | — | — |

-continued

| Ingredient | % by Weight | | | | | |
|---|---|---|---|---|---|---|
| | CC | DD | EE | FF | GG | HH |
| C.I. Acid Red #52[6] | — | 0.00019 | — | — | 0.00019 | — |
| C.I. Acid Yellow #3[7] | 0.0010 | 0.001235 | 0.000452 | — | — | — |
| C.I. Solvent Yellow #33[8] | — | — | — | 0.001 | 0.001235 | 0.000452 |
| Water | to 100% | to 100% | to 100% | to 100% | to 100% | to 100% |
| pH | 4.53 | 4.49 | 4.28 | 4.56 | 4.53 | 4.46 |

[1]Obtained from Sherex
[2]Obtained from Union Carbide
[3]Obtained from E M Industries, Inc.
[4]Obtained from Sandoz Chemicals
[5]Obtained from Sandoz Chemicals
[6]Obtained from Sandoz Chemicals
[7]Obtained from Hilton Davis
[8]Obtained from Tricon Colors Compositions CC through HH were prepared as described for Compositions A-E in Example 1, except the Afflair® 111 was post added, where present, at ambient temperatures.

The red colorants (C.I. Reactive Red #147 or C.I. Acid Red #52 or C.I. Reactive Red #56) in combination with C.I. Acid Yellow #3 in compositions CC, DD, and EE, respectively, produced desirable shades of peach when used in the various amounts and ratios as described.

The yellow colorant (C.I Solvent Yellow #33) present in compositions FF, GG, and HH was added as a premix with propylene glycol because the colorant is insoluble in water. The propylene glycol and C.I. Solvent Yellow #33 were heated together at 100° C. to completely dissolve the yellow colorant.

The red colorants (C.I. Reactive Red #147, C.I. Acid Red #52, and C.I. Reactive Red #56) in combination with C.I. Solvent Yellow #33 in compositions FF, GG, and HH, respectively, produced desirable shades of peach.

| Ingredient | % by Weight | | | |
|---|---|---|---|---|
| | II | JJ | KK | LL |
| 1-trimethyl ammonium 2,3-di (C14–C18 acyloxy) propane chloride (69.0%) | 9.058 | 9.058 | 9.058 | 9.058 |
| Ucarcide® Anti-microbial 250[1] (50%) | 0.14 | 0.14 | 0.14 | 0.14 |
| Calcium Chloride (10%) | 0.20 | 0.20 | 0.20 | 0.20 |
| Perfume | 0.35 | 0.35 | 0.35 | 0.35 |
| C.I. Acid Yellow #17[2] | 0.0010 | — | 0.000452 | — |
| C.I. Reactive Red #147[3] | 0.0010 | 0.0010 | — | — |
| C.I. Acid Yellow #3[4] | — | 0.0010 | — | 0.001235 |
| C.I. Reactive Red #56[5] | — | — | 0.001356 | — |
| C.I. Acid Red #52[6] | — | — | — | 0.00019 |
| Water | to 100% | to 100% | to 100% | to 100% |
| pH | 3.11 | 3.11 | 3.11 | 2.75 |

[1]Obtained from Union Carbide
[2]Obtained from Hilton Davis
[3]Obtained from Sandoz Chemicals
[4]Obtained from Hilton Davis
[5]Obtained from Sandoz Chemicals
[6]Obtained from Sandoz Chemicals Compositions II through LL were prepared using the Biodegradable Cationic diester as described in Example 4 (composition P).

The red colorants (C.I. Reactive Red #147 and C.I. Reactive Red #56) in combination with C.I. Acid Yellow 17 in composition II and KK, respectively, produced desirable shades of peach (within the scope of this present invention) when used in the various amounts and ratios, as specified.

The red colorants (C.I. Reactive Red #147 and C.I Acid Red #52) in combination with C.I. Acid Yellow #3 in composition JJ and LL, respectively, produced desirable shades of peach (within the scope of this present invention) when used in the various amounts and ratios, as specified.

| Ingredient | % by Weight | | | |
|---|---|---|---|---|
| | MM | NN | OO | PP |
| Adogen® 442[1] (76.9%) | 6.775 | 6.775 | 6.775 | 6.775 |
| Varamide® T-55[2] | 1.040 | 1.040 | 1.040 | 1.040 |
| Kathon® CG/ICP-II[3] (1.5%) | 0.02 | 0.02 | 0.02 | 0.02 |
| Citric Acid (10%) | 0.776 | 0.776 | 0.776 | 0.776 |
| Calcium Chloride (10%) | 0.128 | 0.128 | 0.128 | 0.128 |
| Afflair® 111[4] | — | — | — | 0.15 |
| Perfume | 0.35 | 0.35 | 0.35 | 0.35 |
| C.I. Acid Yellow #17[5] | 0.001235 | 0.0010 | 0.0020 | 0.0020 |
| C.I. Reactive Red #147[6] | — | 0.0010 | — | — |
| C.I. Reactive Red #56[7] | — | — | 0.0010 | 0.0010 |
| C.I. Acid Red #52[8] | 0.00019 | — | — | — |
| Water | to 100% | to 100% | to 100% | to 100% |
| pH | 4.58 | 4.55 | 4.60 | 4.64 |

[1]Obtained from Sherex
[2]Obtained from Sherex
[3]Obtained from Rohm & Haas
[4]Obtained from E M Industries, Inc.
[5]Obtained from Hilton Davis
[6]Obtained from Sandoz Chemicals
[7]Obtained from Sandoz Chemicals
[8]Obtained from Sandoz Chemicals Compositions MM through PP were prepared by heating Adogen® 442 and Varamide® T-55 to about 150° F. to form a premix. The premix was then added with stirring to an aqueous phase preheated to about 135° F.

At about 110° F., Kathon® CG/ICP-II was added along with the perfume, and sufficient citric acid to adjust the pH of the composition to the preferred acidity. Calcium chloride was then added along with the make-up water (up to 95% of the total batch weight). Mixing of the composition was concluded at about 95° F. The specified colorants and Afflair® 111 (when present) were post added at ambient temperatures along with the remaining water.

All four (dual softener component) compositions (MM through PP) exhibited desirable peach colors within the scope of this present invention.

| Ingredient | % by Weight QQ | RR | SS |
|---|---|---|---|
| Adogen ® 442[1] (74.9% | 6.798 | 6.798 | 6.798 |
| Ceranine ® Chemical Base 39 (95.0%) | 0.890 | 0.890 | 0.890 |
| Kathon ® CG/ICP-II[3] (1.5%) | 0.0316 | 0.0316 | 0.0316 |
| Glacial Acetic Acid | 1.1066 | 1.1066 | 1.1066 |
| Calcium Chloride (10%) | 0.2375 | 0.2375 | 0.2375 |
| C.I. Acid Yellow #17[4] | 0.001235 | 0.0010 | 0.0020 |
| C.I. Acid Red #52[5] | 0.00019 | — | — |
| C.I. Reactive Red #147[6] | — | 0.0010 | — |
| C.I. Reactive Red #56[7] | — | — | 0.0010 |
| Water | to 100% | to 100% | to 100% |
| pH | 3.42 | 3.44 | 3.45 |

[1]Obtained from Sherex
[2]Obtained from Sandoz Chemicals
[3]Obtained from Rohm & Haas
[4]Obtained from Hilton Davis
[5]Obtained from Sandoz Chemicals
[6]Obtained from Sandoz Chemicals
[7]Obtained from Sandoz Chemicals Compositions QQ through SS were prepared by mixing and heating acetic acid and water to about 175° F. to form an aqueous phase. Ceranine ® Chemical Base 39 was then heated to about 175° F., and mixed into the hot aqueous phase. Calcium chloride was then added to the phase. Adogen( 442 was preheated to about 145° F, and then added to the aqueous phase with constant stirring. Additional calcium chloride was added as needed. After adjusting the pH with additional acetic acid, Kathon ® CG/ICP-II was added at about 110° F., along with the remaining water requirement.

The specified colorants were post added at ambient temperature.

All three (dual softener component) compositions (QQ, RR, SS) exhibited desirable peach color within the scope of this present invention.

EXAMPLE 11

To determine whether direct contact of a liquid fabric conditioning product causes staining by colorant on the fabric, the Direct Staining Test was conducted as follows:

APPARATUS, MATERIALS

| |
|---|
| 250 ml beaker |
| Glass stirring rod |
| 5.75" × 5.75" swatches of: |
| Terry cloth |
| 65/35 Dacron/cotton permanent press |
| Diaper (100% cotton Birdseye type) |
| Lycra |
| Silk |
| Wool |
| 65/35 Dacron/cotton |
| Acetate Rayon Taffeta |
| Spun Dacron |
| Spun Nylon |
| Spun Orlon |
| Spun Viscose |
| Banlon |
| Wool flannel |
| Texturized polyester twill |
| Polyester double knit |
| ½ teaspoon measure |
| Kenmore ® washing machine - Model 70 or equivalent |
| Detergent |
| Medicine dropper |

Procedure

Fabric swatches were washed in 100° F. water with detergent. At the completion of the wash, the machine was allowed to spin only long enough to remove excess wash solution. The cloths were not spray rinsed or rinsed in any way. All cloths were removed from the washing machine and dried in a static dryer. After drying, 20 drops fabric conditioner were applied directly to the cloths and the cloths were folded with pressure in order to obtain about a 2" circle. The stained cloths were allowed to age about 24 hours, then put through a rinse cycle only in the Kenmore ® washing machine (no additional softener was added). The cloths were dried again. The cloths were evaluated under simulated northern daylight and rated for residual staining according to the following system:

0—no staining
2—trace
4—slight
6—moderate
8—considerable staining

The scores obtained for each cloth were then added to obtain a total staining score. The test was repeated for every fabric conditioning composition that was tested. The lower the total staining score, the less staining there was.

TEST RESULTS

The Direct Staining Test was performed to compare staining by the inventive composition with staining by non-commercial green, non-commercial pink, commercial blue, and commercial yellow colored fabric softeners. The peach colored fabric conditioning composition according to the present invention included 8.366% Adogen ® 442, 0.14% Ucarcide ® Antimicrobial 250, 0.35% perfume, 0.15% Afflair ® 111, 0.000452% C.I. Acid Yellow #17, and 0.001248% C.I. Reactive Red #56. Results of the test were as follows:

| | Total Staining Score |
|---|---|
| 1) Commercial Yellow Fabric Softener I containing 0.001% of a yellow colorant. | 62 |
| 2) Commercial Blue-colored Fabric Softener II 0.0033% of a blue colorant. | 50 |
| 3) Non-commercial Green-colored Fabric Softener III containing 0.001% of a green colorant. | 58 |
| 4) Non-Commercial Pink-colored Fabric Softener IV containing 0.0014% C.I. Reactive Red No. 56 and 0.15% Afflair ® 111. | 40 |
| 5) Peach-colored Fabric Softener composition according to the present invention containing 0.000452% C.I. Acid Yellow No. 17, 0.001248% Reactive Red No. 56. and 0.15% Afflair ® 111. | 48 |

It can be seen that even after direct contact for 24 hours the peach-colored fabric conditioner composition according to the present invention stained less than the other colored fabric softeners to which it was compared, except for the non-commercial pink-colored softener (i.e. No. IV). In comparison to composition IV, the softener composition containing the inventive peach colorant system stained slightly more.

Since composition IV (pink) contains the same red colorant as used in the peach colorant system, and was found to stain less, the difference in the staining scores between the two compositions is due to the presence of the yellow colorant in the peach colorant system. Overall, the commercial yellow fabric softener composition (I) was found to be more staining than all of the other colored fabric softener compositions tested.

This Example illustrates that in addition to providing an aesthetically pleasing color, the colorant system used in the fabric conditioning compositions according to the present invention produces less staining under direct staining conditions than the two commercially available liquid conditioning products which are not within the scope of this invention.

What is claimed is:

1. A liquid fabric conditioning composition comprising;

a) about 1% to about 40% by weight of said composition of a fabric softening component comprising a cationic fabric softening compound; and b) about 2 ppm to about 1,000 ppm of a colorant system comprising a yellow colorant selected from the group consisting of C.I. Acid Yellow #17, C.I. Acid Yellow #3, C.I. Solvent Yellow #33 and mixtures thereof and a red colorant selected from the group consisting of C.I. Reactive Red #56, C.I. Reactive Red #147, C.I. Acid Red #52 and mixtures thereof, the pH of the composition being less than about 7.

2. The composition of claim 1 wherein the yellow colorant is C.I. Acid Yellow #17 or C.I. Acid Yellow #3 and the red colorant is selected from the group consisting of C.I. Reactive Red #56, C.I. Acid Red #52 and C.I. Reactive Red #147.

3. The composition of claim 2 wherein the red colorant is C.I. Reactive Red #56 and the yellow colorant is C.I. Acid Yellow #17.

4. The composition of claim 1 wherein the composition comprises about 2 ppm to about 1000 ppm of the colorant system.

5. The composition of claim 1 wherein the composition comprises about 1 to about 500 ppm of the red colorant and about 1 to about 500 ppm of the yellow colorant.

6. The composition of claim 2 wherein a ratio of the red colorant C.I. Reactive Red #56 to the yellow colorant C.I. Acid Yellow #17 or C.I. Acid Yellow #3 in the composition is about 4:1 to about 1:3 red to yellow colorants.

7. The composition of claim 2 wherein the ratio of the red colorant C.I. Reactive Red #147 to the yellow colorant C.I. Acid Yellow #17 or C.I. Acid Yellow #3 in the composition is about 1:1 to about 1:5 red to yellow colorants.

8. The composition of claim 2 wherein the ratio of the red colorant C.I. Acid Red #52 to the yellow colorant C.I. Acid Yellow #17 or C.I. Acid Yellow #3 in the composition is about 1:5 to about 1:25 red to yellow colorant.

9. The composition of claim 2 further comprising a pearlizing agent selected from the group consisting of ethylene glycol distearate or microfine mica.

10. The composition of claim 9 wherein the microfine mica is titanium dioxide coated mica, having a particle size in the range of about 1 to about 15 microns.

11. The composition of claim 1 wherein the composition comprises about 4% to about 35% of the fabric softening component.

12. A composition of claim 1 wherein the composition comprises about 5% to about 30% of the fabric softening component.

13. The composition of claim 1 wherein the fabric softening component is selected from the group consisting of acyclic quaternary ammonium salts having at least two $C^{8-30}$ alkyl chain, quaternary imidazolinium salts, diamido quaternary ammonium salts, biodegradable quaternary ammonium salts and mixtures thereof.

14. The composition of claim 13 wherein the fabric softening component is selected from the group consisting of di(hydrogenated tallow)dimethyl ammonium chloride, ditallowimidazolinium chloride and a biodegradable cationic diester of formula

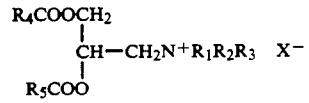

15. The composition of claim 1 wherein the fabric softening component comprises: an acyclic quaternary ammonium salt and an ethoxylated fatty amide.

16. The composition of claim 15 wherein the acyclic quaternary ammonium salt is di(hydrogenated tallow) dimethyl ammonium chloride and the ethoxylated fatty amide is tallow mono ethanolamide.

17. The composition of claim 1 wherein the fabric softening component comprises: an acyclic quaternary ammonium salt and a reaction product of stearic acid and an aminoethylethanolamine.

18. The composition of claim 1 wherein the pH of the composition is about 2.5 to about 6.5.

19. A method for softening fabrics comprising treating the fabrics in an aqueous bath with the fabric conditioning composition of claim 1.

* * * * *